US010190840B1

(12) United States Patent
Renteria

(10) Patent No.: US 10,190,840 B1
(45) Date of Patent: Jan. 29, 2019

(54) FIREARM SUPPORT

(71) Applicant: James Renteria, Niceville, FL (US)

(72) Inventor: James Renteria, Niceville, FL (US)

( * ) Notice: Subject to any disclaimer, the term of this patent is extended or adjusted under 35 U.S.C. 154(b) by 24 days.

(21) Appl. No.: 15/049,090

(22) Filed: Feb. 21, 2016

(51) Int. Cl.
*F41A 23/02* (2006.01)

(52) U.S. Cl.
CPC ..... *F41A 23/02* (2013.01)

(58) Field of Classification Search
CPC ..... F41A 23/02; F41A 23/04; F41A 23/06; F41A 23/08; F41A 23/10; F41A 23/16
USPC ..... 42/90, 94, 72; 89/37.04, 37.01
See application file for complete search history.

(56) References Cited

U.S. PATENT DOCUMENTS 897,577 A * 9/1908 Bourne ..... F41C 23/10 42/59
1,441,285 A * 1/1923 Johnston ..... F41A 23/08 42/94
2,664,659 A * 1/1954 Parker ..... F41A 23/00 42/94
3,327,422 A * 6/1967 Harris ..... F41A 23/08 42/94
4,625,620 A * 12/1986 Harris ..... F41A 23/08 42/94
6,785,997 B2 * 9/2004 Oz ..... F41G 1/35 42/146
7,559,167 B1 * 7/2009 Moody ..... F41G 11/003 42/71.01
7,568,304 B1 * 8/2009 Moody ..... F41A 23/08 42/71.01
7,631,455 B2 * 12/2009 Keng ..... F16M 11/10 248/163.1
D672,838 S 12/2012 Mayberry et al.
8,707,604 B2 * 4/2014 Troy ..... F41A 23/10 248/169
9,027,274 B2 * 5/2015 Pientka ..... F41A 23/18 42/94
9,097,480 B2 * 8/2015 Keng ..... F41A 9/65
9,182,194 B2 8/2015 Moore
9,335,113 B1 * 5/2016 Chen ..... F41A 35/00
2004/0068911 A1 * 4/2004 Schurtenberger ..... F41A 23/02 42/94
2006/0278797 A1 * 12/2006 Keng ..... F41A 23/10 248/440.1
2009/0000175 A1 * 1/2009 Potterfield ..... F41A 23/10 42/94
2009/0126250 A1 * 5/2009 Keng ..... F41A 23/10 42/94
2011/0107643 A1 * 5/2011 Fitzpatrick ..... F41C 23/16 42/72
2013/0000174 A1 * 1/2013 Troy ..... F41C 23/16 42/72

(Continued)

*Primary Examiner* — Jonathan C Weber
(74) *Attorney, Agent, or Firm* — NK Patent Law, PLLC

(57) ABSTRACT

A firearm support attaches to a lower surface of a firearm and helps steady the firearm during shooting from almost any firing position. The support has a body member that has a firearm lower railing receiving channel on its upper surface and a downwardly and forwardly curving claw extending from the lower surface at the front. The claw has a rounded edge and a centrally disposed wedge opening. The lower surface of the body member is also curved as is the rear surface. A pair of extendions extends outwardly, one from each side of the body member just above the upper end of the claw and each has a forward facing surface that is flat.

17 Claims, 9 Drawing Sheets

(56) References Cited

U.S. PATENT DOCUMENTS

| | | | | |
|---|---|---|---|---|
| 2014/0007482 | A1* | 1/2014 | Pientka | F41A 23/18 42/94 |
| 2015/0233668 | A1* | 8/2015 | Moore | F41C 23/16 42/72 |
| 2016/0069632 | A1* | 3/2016 | Williams | F41A 23/16 42/94 |

* cited by examiner

FIREARM SUPPORT

BACKGROUND OF THE INVENTION

1. Field of the Invention

The present invention relates to a support or vertical grip that extends downwardly from the lower rail of a rifle and assists the shooter in supporting the rifle during various firing modes of the rifle.

2. Background of the Prior Art

When shooting a rifle at a shooting range, such as the military's M-16 or the civilian counterpart, the AR-15, many shooters take one of a handful of positions, including the standing position, the sitting position, the kneeling position, or the prone position. In such positions, the shooter uses the non-trigger hand to support the rifle from underneath, typically by grasping the lower rail, and uses the opposing hand to fire the rifle. Some shooters may support the rifle on the bench top or a sandbag, for example, especially when in the sitting or prone position. When sighting a rifle in, shooters may use an appropriate support in order to keep the rifle absolutely steady during shot firing. Such non-trigger hand support, or bench, sandbag, or other item support, tends to prove a sufficiently satisfactory method of steadying the rifle for shot accuracy on the range. The shooter gets into position, supports the rifle as described, finds the sight picture of the target in the rifle's sights, and fires off on or more rounds and thereafter determines his or her accuracy. Whether the shooter is shooting the rifle for fun, for training, or for qualification, such shooting tends to be a relatively low stress event.

However, in an active shooting environment, such as in combat or in a police encounter, the stress level is extremely high with the shooter's adrenaline gushing. In such events getting a good shot off in order to eliminate the active threat may mean the difference between life and death for the shooter or others depending on the shooter. In such live-fire situations, the shooter looks for every advantage in order to have the most accurate shot possible in order to suppress the danger down range. The shooter tries to have the front portion of the rifle held as steady as possible in order to be able to prosecute the most accurate shots possible in a minimum amount of time.

While non-trigger hand and arm support, or bench or sandbag support is sufficient for rifle steadying on the range, a shooter in a live fire situation looks for a more robust method of being able to bring the muzzle of the rifle to bear onto the target and to keep the rifle as steady as possible during shot discharge. To address this need for gun steadying, gun handles, often referred to as vertical supports, have been proposed. Such gun handles tend to be removably mounted to the underside of the rifle, typically to the lower rail of the rifle, and help hold the rifle steady during shooting of the rifle. Such gun handles are in addition to or in lieu of the user's non-trigger hand and arm support.

Such gun handles, which come in a variety of architectures, offer additional steadying support of the rifle during shooting, but have certain shortcomings. Many gun handles are a single post design, often with finger grip grooves, that extends downwardly from the rifle when the gun handle is installed. When shooting, the uses rests the distal end of the gun handle on an appropriate surface and the gun handle acts as a monopod to help steady the rifle. Alternately, the user grips the gun handle in lieu of the lower rail in order to steady the rifle with the non-trigger hand and arm. Each of these steadying techniques may prove satisfactory whenever the shot or shots being taken are generally straight forward down range. However, a shooter in a live fire situation can find himself or herself in a whole host of situations and positions from which a shot needs to be taken. For example, the target may be at an adverse angle relative to the shooter, either initially, or after dispatch of the initial shot or shots, requiring the shooter to position or reposition the rifle at such adverse angle. Alternately, the shooter needs to shoot around objects and steady the rifle so as not to shoot into the obstructions present. Often, the surface onto which the shooter desires to steady the rifle may either be very narrow or non-flat. For example, the steadying object for the rifle may be a pipe at the top of a chain link fence. In these and other firing situations, the typical vertical support often proves less than completely effective, if at all, in helping dispatch the best possible shots at the threat present.

What is needed is a gun handle that allows a shooter to be able to steady the rifle in order to achieve the best possible shot in order to give the shooter the best chance for a kill of the threat present. Such a gun handle must be versatile in a multitude of shooting situations and positions, not just a straight forward shot steadied by a wide flat surface upon which the handle is mounted.

SUMMARY OF THE INVENTION

The firearm support of the present invention addresses the aforementioned needs in the art by providing a gun handle that attaches to the lower surface of a rifle, such as to the lower rail, and is substantially more versatile in steadying the rifle during shot prosecution relative to a standard monopod type of gun handle. Specifically, the firearm support has a relatively wide base allowing the rifle to be positioned in or repositioned to a relatively wider degree of firing angles while adding the requisite support needed for fat initial shots and follow on shots. The firearm support of the present invention has a relatively wide head that allows a shooter to cant the firearm and provides a stable platform for shooting from adverse positions and angles. The firearm support forces pressure downward and forward into an obstacle or barricade providing a stable firing position for the firearm even if firing one handed which is especially useful if the shooter is wounded, allowing the wounded shooter to use the device by leveraging the shooter's body and the device against an obstacle, barricade or piece of cover. The firearm support is simple in design and construction, being produced using standard manufacturing techniques, and is lightweight, easy to install and remove, and permits a user to use his or her favorite grips and rails on the firearm as desired. The offset and geometry of the firearm support gives the shooter proper muzzle sight relationship when shooting around objects by forcing the barrel away from the object helping prevent firing into the object during high stress firing. The firearm support is configured to stabilize the firearm when resting the present invention on a linear object, such as a railing or a non-flat object such as a pipe. The firearm support is configured to function as a stand in order to support the firearm to which the device is attached when the firearm is resting in a generally vertical position against a flat surface. The firearm support has a relatively large cross-guard section that helps steady the firearm when the present invention is jammed up against an object, such as a wall or window sill, while allowing pivot support when swinging the firearm to one side or the other for shooting. This area also serves as a thumb support when using the device as a grip. The firearm support effectively functions as a grip stop, either alone or in conjunction with other grip stops or attachments. In close combat, the firearm support acts as an effective striking surface when bringing the firearm bearing the device downwardly onto an adversary.

The firearm support of the present invention is comprised of a body member that has a top, a bottom, a front, a rear, a first side and a second side. A first rail extends upwardly from the top proximate the first side while a second rail extends upwardly from the top proximate the second side such that the second rail, the first rail and the top form a channel that is shaped and dimensioned to receive and hold the lower rail of the firearm therein. A claw extends outwardly and downwardly in curved fashion from the bottom of the body member proximate the front. The claw has a bottom edge. A bolt passes through a first opening on the first rail and a corresponding second opening on the second rail and is partially seated within a groove formed within the top, the groove extending between the first opening and the second opening. A first extension extends outwardly from the first side of the body member at the front above the claw while a second extension extends outwardly in opposing direction from the second side of the body member at the front above the claw. The first extension and the second extension are each generally rectangular in shape. A first forward facing surface of the first extension is flat and a second forward facing surface of the second extension is flat. The claw has a centrally disposed wedge extending from the bottom edge partially toward the body member and the bottom edge of the claw is rounded so that the claw resembles a claw of a hammer. The claw has a forward facing surface that is concavely curved. The bottom of the body member is concavely curved as is the back of the body member and the bottom of the body member meets the back of the body member at a rounded lip.

BRIEF DESCRIPTION OF THE DRAWINGS

Similar reference numerals refer to similar parts throughout the several views of the drawings.

DESCRIPTION OF THE PREFERRED EMBODIMENT

Figure 1:
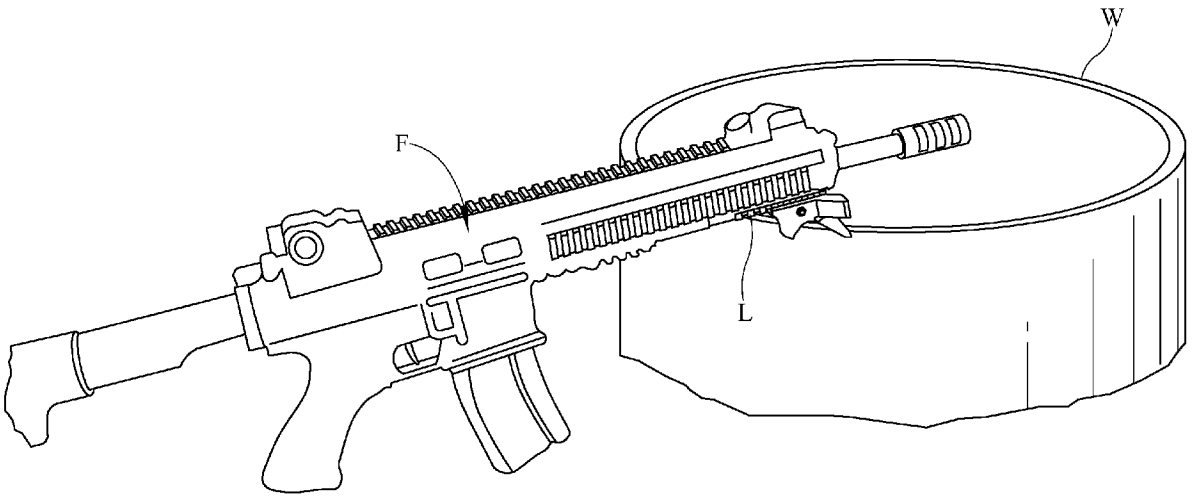
FIG. 1 is an environmental view of the firearm support of the present invention stabilizing a firearm on a linear object.
Figure 2:
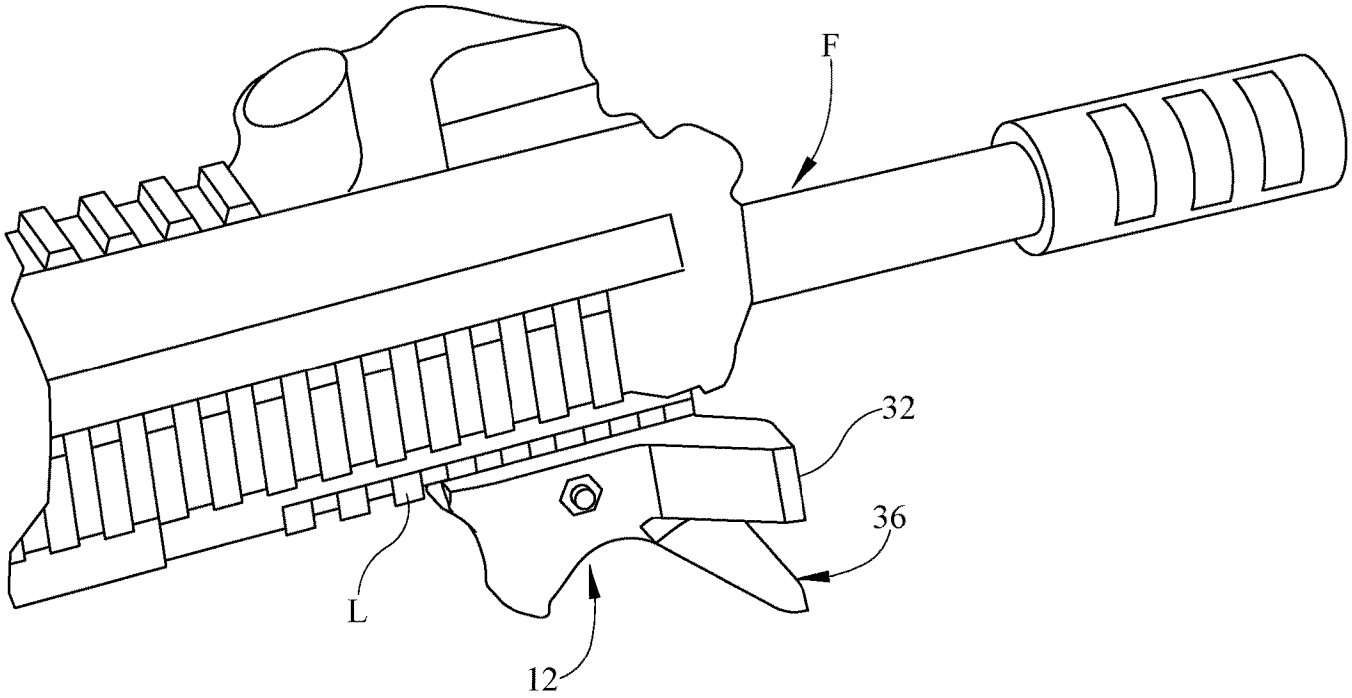
FIG. 2 is a close-up perspective view of the firearm support attached to the firearm.
Figure 3:
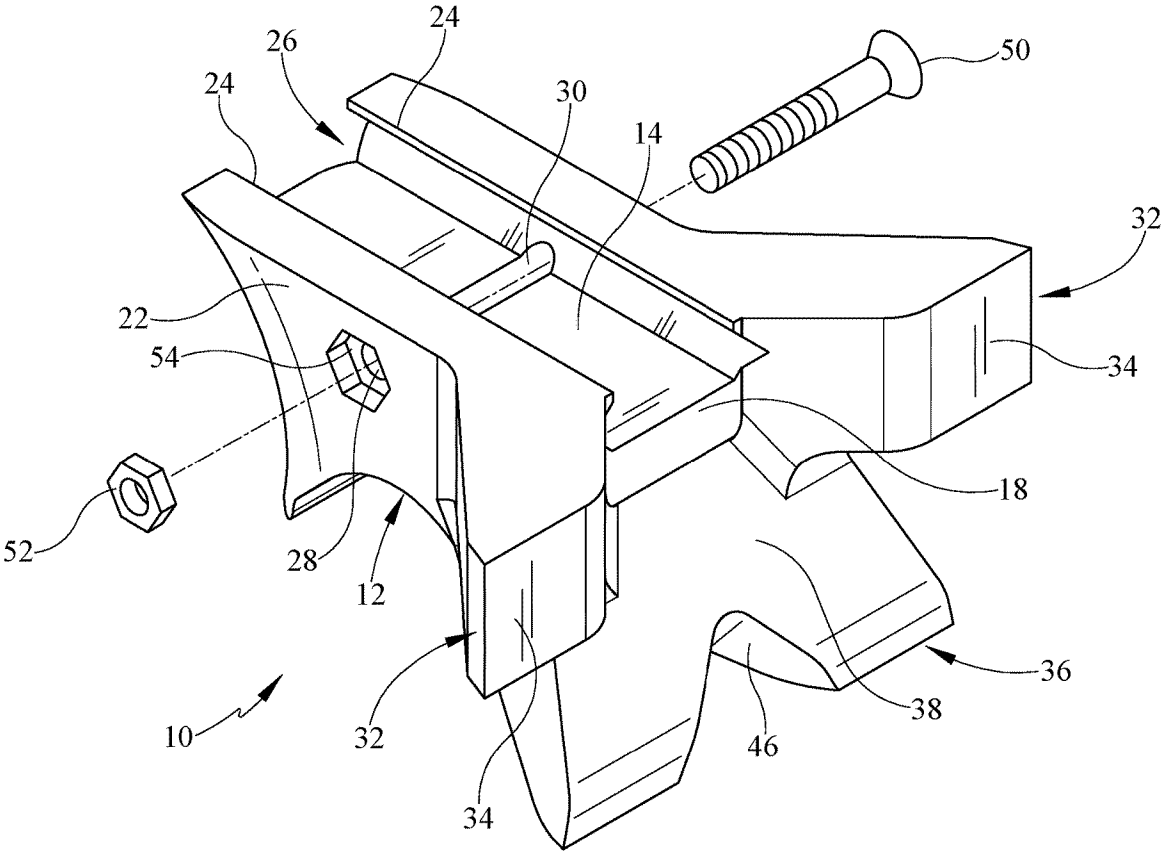
FIG. 3 is an upper forward perspective view of the firearm support.
Figure 4:
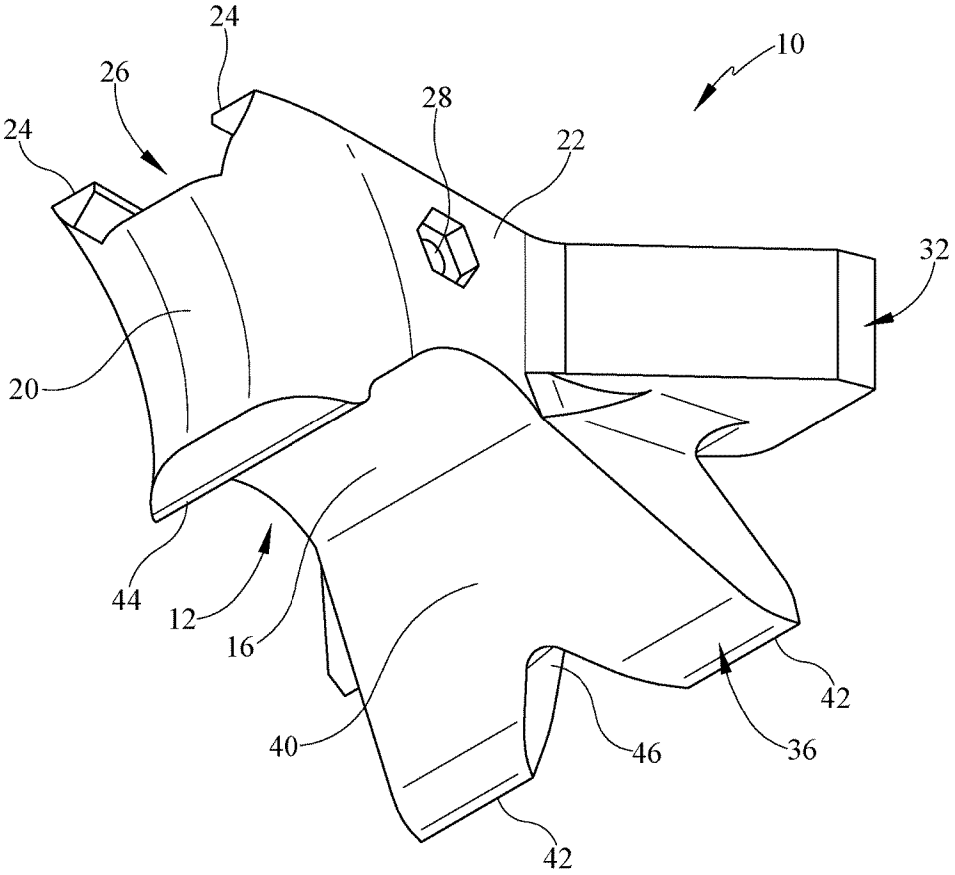
FIG. 4 is a lower rearward perspective view of the firearm support.
Figure 5:
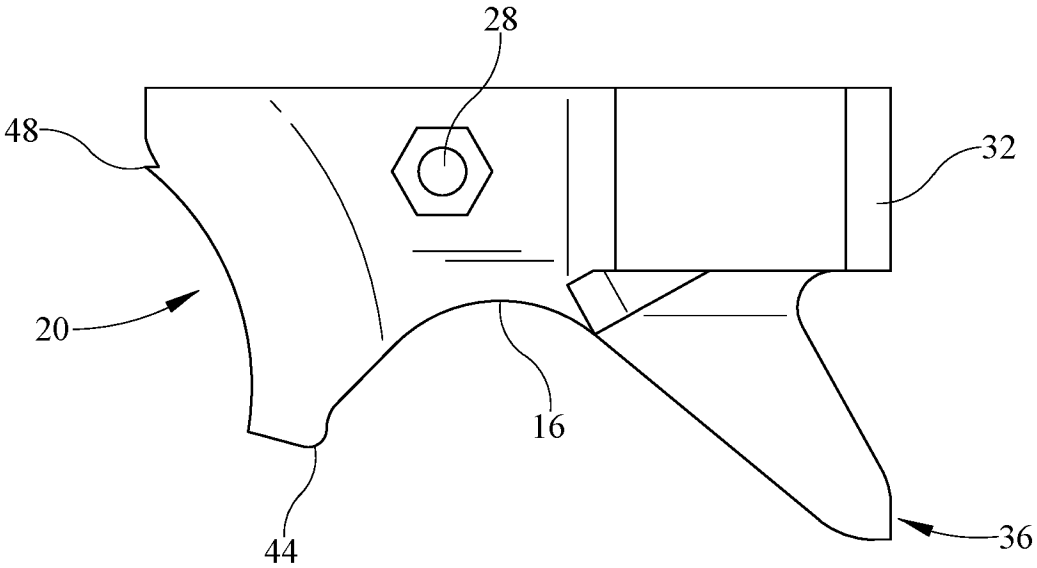
FIG. 5 is a side view of the firearm support.
Figure 6:
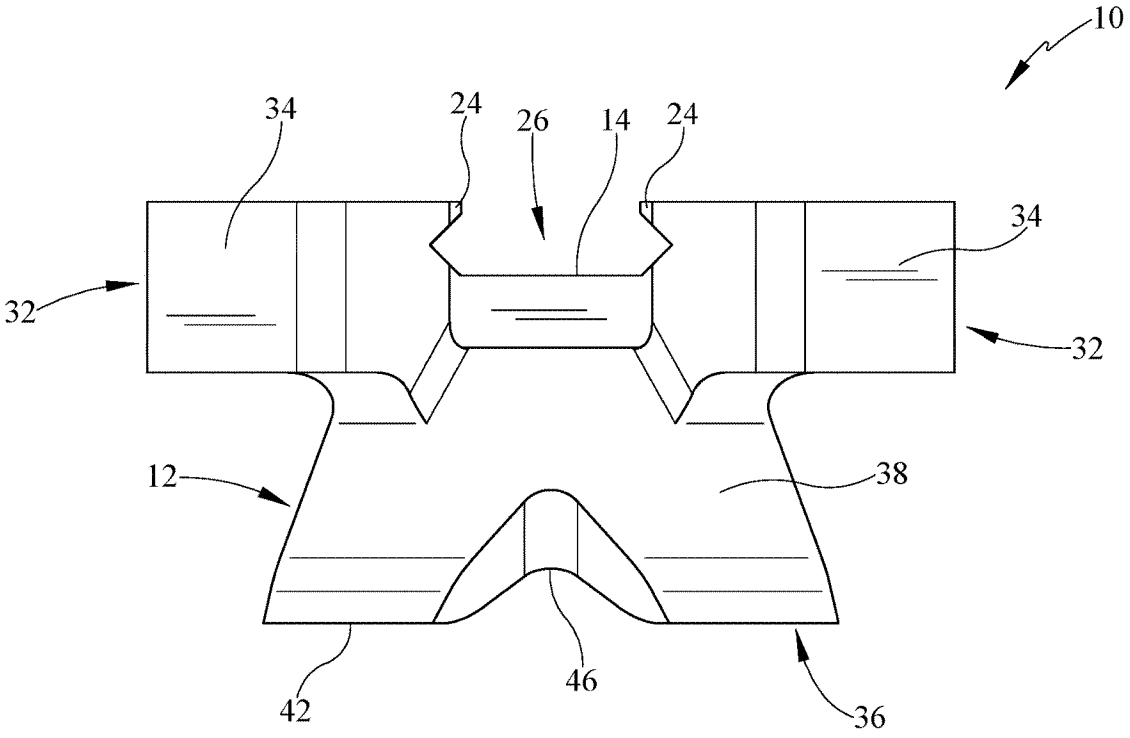
FIG. 6 is a front view of the firearm support.
Figure 7:
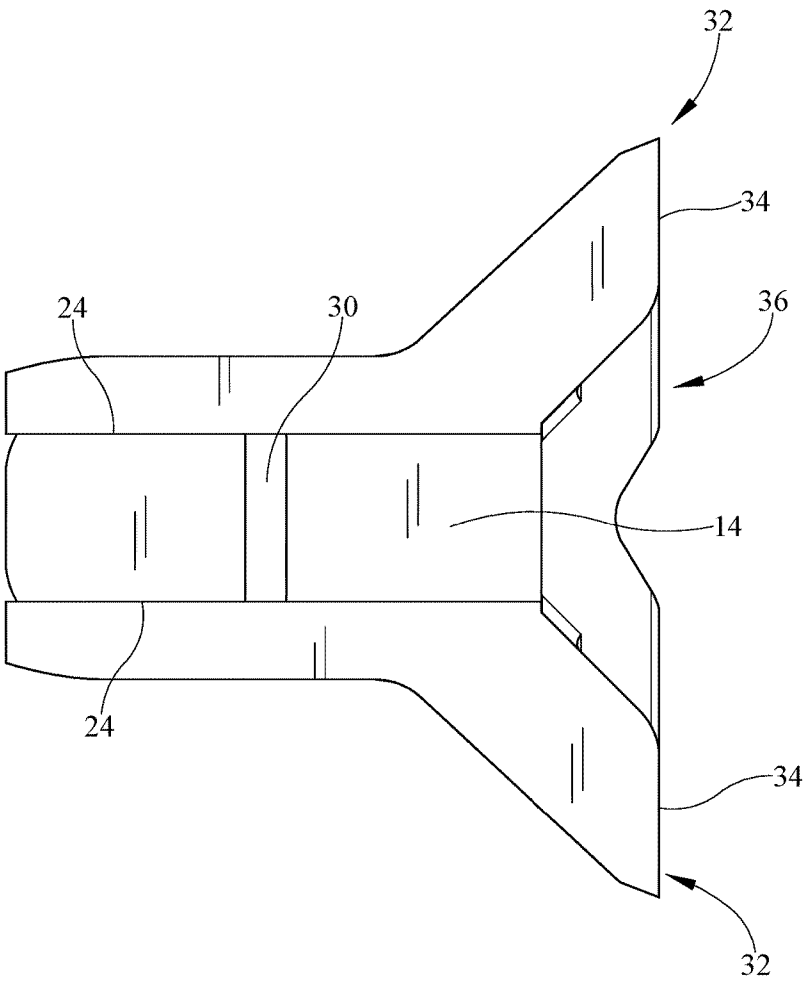
FIG. 7 is a top view of the firearm support.

Referring now to the drawings, it is seen that the firearm support of the present invention, generally denoted by reference numeral 10, is comprised of a body member 12 that has a top 14, a bottom 16, a front 18, a rear 20, a pair of sides 22, the firearm support 10 essentially symmetrical about a midline passing from the front 18 to the rear 20 between the pair of sides 22.

As seen, a pair of spaced apart rails 24 upwardly extends upwardly from the top 14 of the body member 12 one each at either side 22 of the body member 12. The pair of rails 24 along with the surface of the top 14 form a channel 26 that is shaped and dimensioned to receive a lower rail L of a firearm F in the usual way. As seen, corresponding openings 28 are provided, one on each respective rail 24 while a bolt groove 30 extends between the two openings 28 and within the surface of the top 14.

As seen, a pair of extensions 32 extends outwardly, one extension 32 from each side 22 of the body member 12. Each extension 32 is essentially rectangular in shape with its forward facing surface 34 being substantially flat. Extending downwardly and curving forwardly from the body member 12, and possibly a small portion of the proximal end of each extension 32, is a claw 36. As seen, the claw 36 has a concavely curved forward facing surface 38 as well as a rearward facing surface 40 that is curved slightly at the rounded bottom edge 42 of the claw 36 and then the rearward facing surface 40 is essentially flat (or slightly curved) and then transitions into the bottom 16, the surface of which is concave, terminating in a rounded lip 44. As seen, the bottom edges 42 and the forwardly-facing surfaces 34 form a plane. The claw 36 has a centrally disposed wedge opening 46 extending inwardly from the bottom edge 42 partially toward the body member 12

The rear 20 of the body member 12 is concavely rounded and terminates in a pair of nubs 48 one each located on a respective one of the rearward ends of rails 24.

The body member 12 including the rails 24 and claw 36 are made from an appropriate and sturdy material such as plastic, lightweight aluminum, carbon fiber, etc., and are formed as a unitary, indeed monolithic unit in standard manufacturing fashion.

In order to use the firearm support 10 of the present invention, the firearm support 10 is attached to the lower rail L of the firearm F by receiving the lower rail L within the channel 26 formed by the top 14 and the rails 24. The firearm support 10 is positioned so that the bolt groove 30 is positioned between a pair of ribs R of the lower rail L. A bolt 50 is passed through the corresponding openings 28 on the rails 24, being seated within the bolt groove 30, and an appropriate nut 52 is secured to the distal end of the bolt 50. If desired, a depression 54 can be formed in one or both of the openings 28 on the outer surface of the respective rail 24 and possibly the body member 12, such depression 54 being shaped and dimensioned to correspond to the size and shape of the nut 52 so that the nut 52 is seated within the depression 54 and thereafter the bolt 50 passes into the nut 52 in order to hold the nut 52 steady during bolt 50 tightening. The firearm support 10 is now ready to be used to help steady the firearm F during shooting of the firearm F in almost any firing position desired by the user.

Figure 8:
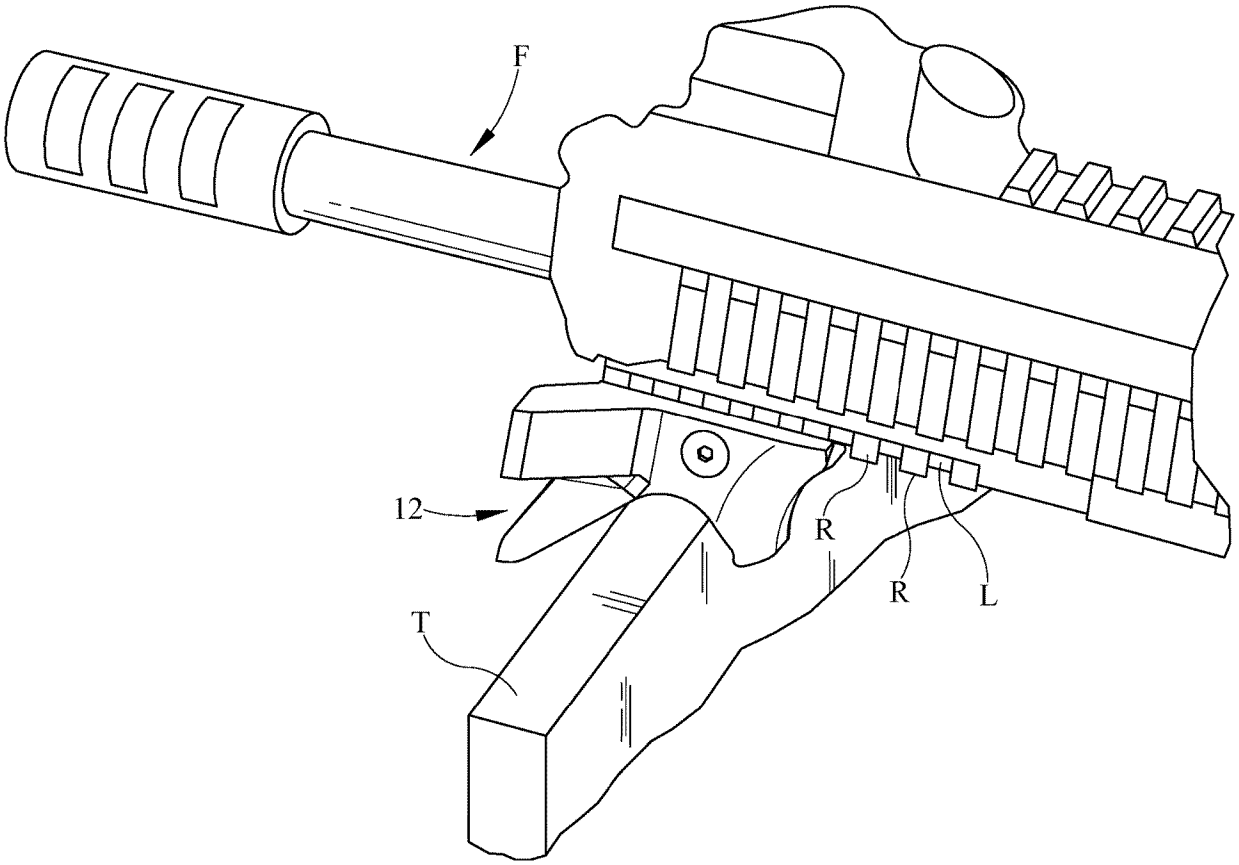
FIG. 8 is a close-up environmental view of the firearm support supporting the firearm on a fence rail.
Figure 9:
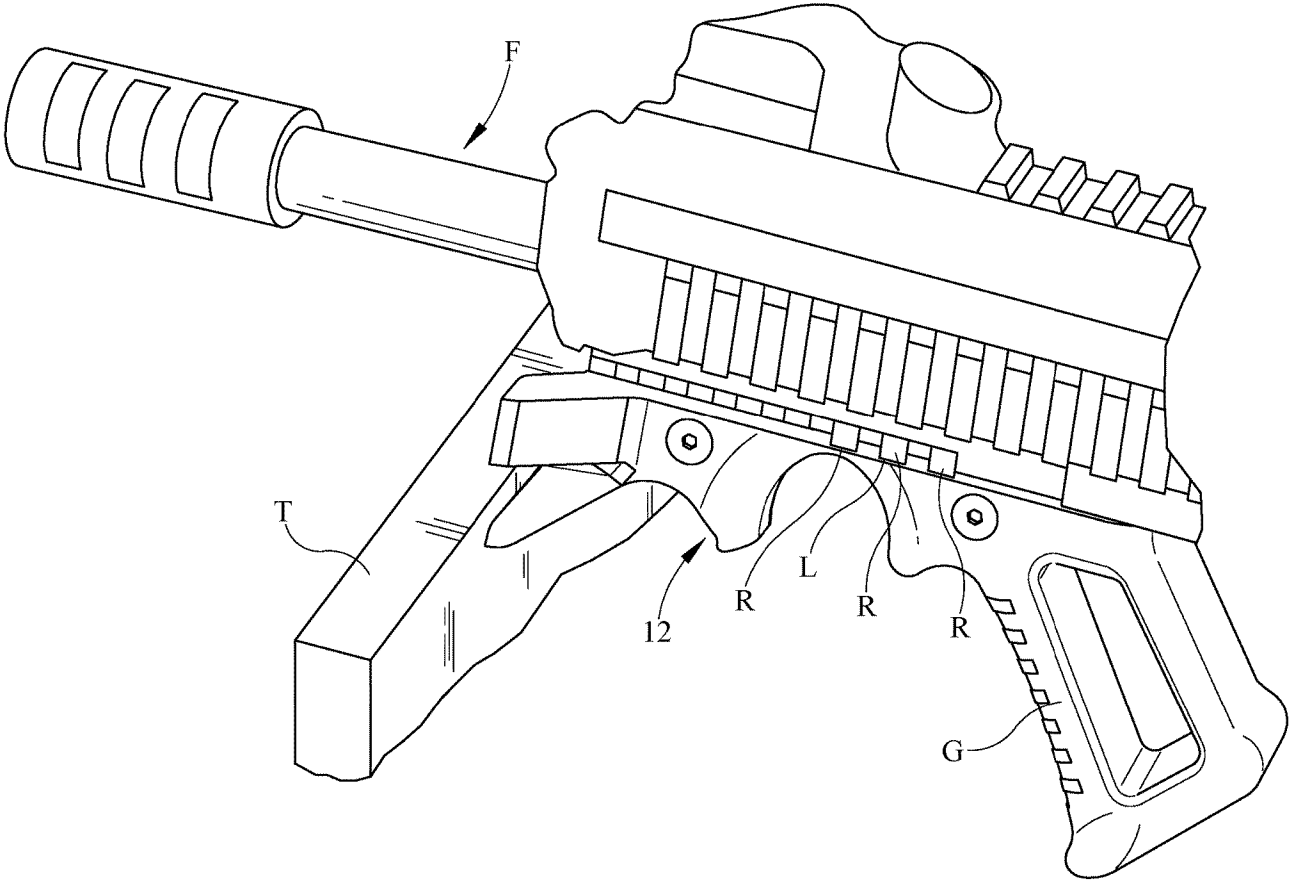
FIG. 9 is a close-up environmental view of the firearm support supporting the firearm against the fence rail with an optional hand grip attached to the lower rail of the firearm.

In its most basic function, the bottom edge 42 of the firearm support 10 is used to rest the firearm support on a surface, which may or not be flat, and thereby hold the firearm F steady. Alternately, the firearm support 10 can be used as a hand grip by the shooter. The rounded nature of the bottom edge 42 of the claw 36 permits the shooter to pivot the firearm F up and down about this bottom edge 42 while maintaining firearm F stability. In similar fashion, the firearm F can be rotated left or right about this bottom edge 42 or titled to either side about a respective one of the corners of the bottom edge 42. If the surface upon which the claw 36 is resting is relatively soft, such as a sandbag or the ground, then the bottom edge 42 can be used to dig the firearm support 10 into such soft surface in order to have a particularly strong securement and steadfast support of the firearm F. The relatively flat outer edges of the extensions 32 can be used to brace the firearm F against a side surface such as a wall, gaining additional support from the corners of the claw 36 if the firearm F is titled, while the relatively flat forward facing surfaces 34 of the extensions 32 can be used to brace the firearm F forwardly into a flat surface such as a horizontally disposed rail. If such flat surface is relatively large, such as the top of a rail T, then the bottom edge 42 of the claw 36 is used to steady the firearm F, as seen in FIG. 9. As seen in FIG. 8, the rear facing surface 40 of the claw 36 in conjunction with the bottom 16 of the body member 12 can be used to rest the firearm support 10 on the top surface of the rail T. Due to the curved nature of the bottom 14, such top resting of the firearm support 10 is effective when the resting surface is rounded, such as a pipe. The curved forward facing surface 38 of the claw 36 allows the firearm F to be forwardly braced into such rounded surface while the curved nature of the rear 20 allows the firearm F to be rearwardly braced onto such rounded surface or even a flat surface. The wedge 46 of the claw 36 can be used to saddle the firearm support 10 onto an edge of a relatively thin wall W, as seen in FIG. 1, gaining additional support from the rounded lip 44 of the bottom 16 whenever the firearm F is tilted upwardly. Other braced positions are achievable with the firearm support 10. As seen in FIG. 9, the firearm support 10 can be used in conjunction with other accessories, such as the illustrated grip G, attached to the lower rail L of the firearm F In close combat, the user can strike downwardly or sidewardly with the firearm F onto the assailant, making contact with the assailant with the bottom edge 42 of the claw 36, or just the corners thereof, in order to achieve a relatively high pressure per square inch debilitating impact onto the assailant.

Whenever use of the firearm support 10 is no longer desired, the bolt 50 is unscrewed from the nut 52 and removed, along with the nut 52, and the firearm support 10 is simply detached from the lower rail L of the firearm F While the invention has been particularly shown and described with reference to an embodiment thereof, it will be appreciated by those skilled in the art that various changes in form and detail may be made without departing from the spirit and scope of the invention.

I claim:

1. A support for attachment to a firearm having a lower rail, the support comprising:

a body member having a top surface, a bottom surface, a front, a rear, a first side, and a second side;

a pair of parallel rails extending across the top surface from the rear to the front to form a channel configured to receive and hold the lower rail;

a pair of first extensions extending from the front and terminating in a pair of forward-facing surfaces, wherein the pair of first extensions are symmetrical about a plane defined by a set of points equidistant from the first outer wall and the second outer wall;

a two-pronged claw extending from the bottom surface proximate the front, each prong of the claw terminating in a bottom edge, wherein the bottom edges and the forward-facing surfaces form a plane;

a second extension extending from the bottom surface proximate the rear and terminating in a rounded lip;

wherein the pair of first extensions and the two-pronged claw form a substantially concave surface configured to receive curved surfaces, and wherein the two-pronged claw and second extension form a substantially concave surface configured to receive curved surfaces.

2. The support of claim 1 further comprising a bolt that passes through corresponding openings in the pair of parallel rails.

3. The support of claim 2 further comprising a groove formed within the top surface extending between the corresponding openings.

4. The support of claim 1, wherein the forward-facing surfaces are substantially flat.

5. The support of claim 1, wherein the two-pronged claw has a centrally disposed wedge between the two prongs.

6. The support of claim 1, wherein the bottom edges are rounded.

7. The support of claim 1, wherein the pair of first extensions, two-pronged claw, and second extension are fixed and immobile.

8. A firearm stabilizing system comprising:

a firearm having a lower rail; and a support for attachment attached to the lower rail comprising:

a body member having a top surface, a bottom surface, a front, a rear, a first side, and a second side;

a pair of parallel rails extending across the top surface from the rear to the front to form a channel configured to receive and hold the lower rail;

a pair of first extensions extending from the front and terminating in a pair of forward-facing surfaces, wherein the pair of first extensions are symmetrical about a plane defined by a set of points equidistant from the first outer wall and the second outer wall;

a two-pronged claw extending from the bottom surface proximate the front, each prong of the claw terminating in a bottom edge, wherein the bottom edges and the forward-facing surfaces form a plane;

a second extension extending from the bottom surface proximate the rear and terminating in a rounded lip;

wherein the pair of first extensions and the two-pronged claw form a first substantially concave surface configured to receive curved surfaces, and wherein the two-pronged claw and second extension form a second substantially concave surface configured to receive curved surfaces.

9. The system of claim 8 further comprising a bolt that passes through corresponding openings in the pair of parallel rails.

10. The system of claim 9 further comprising a groove formed within the top surface extending between the corresponding openings.

11. The system of claim 8, wherein the forward-facing surfaces are substantially flat.

12. The system of claim 8, wherein the two-pronged claw has a centrally disposed wedge between the two prongs.

13. The system of claim 8, wherein the bottom edges are rounded.

14. The system of claim 8, wherein the pair of first extensions, two-pronged claw, and second extension are fixed and immobile.

15. The system of claim 8, wherein a user of the system stabilizes the firearm by placing at least one of the forward-facing surfaces and bottom edges against a surface.

16. The system of claim 8, wherein a user of the system stabilizes the firearm by placing the first substantially concave surface against a curved surface.

17. The system of claim 8, wherein a user of the system stabilizes the firearm by placing the second substantially concave surface against a curved surface.

* * * * *